US007324772B2

(12) United States Patent
Harris et al.

(10) Patent No.: US 7,324,772 B2
(45) Date of Patent: Jan. 29, 2008

(54) POINT-OF-LOAD DESIGN FOR HIGH VOLTAGE AC POWER SUPPLIES

(75) Inventors: William Ross Harris, Livonia, NY (US); Jerry Floyd Adams, Waterport, NY (US)

(73) Assignee: Xerox Corporation, Norwalk, CT (US)

( * ) Notice: Subject to any disclaimer, the term of this patent is extended or adjusted under 35 U.S.C. 154(b) by 314 days.

(21) Appl. No.: 11/157,917

(22) Filed: Jun. 22, 2005

(65) Prior Publication Data

US 2006/0290331 A1 Dec. 28, 2006

(51) Int. Cl.
*G03G 15/00* (2006.01)

(52) U.S. Cl. ..... 399/88; 399/89; 361/235

(58) Field of Classification Search ..... 399/37, 399/88, 89, 115, 170; 323/247, 305, 328; 361/225, 235, 623, 836
See application file for complete search history.

(56) References Cited

U.S. PATENT DOCUMENTS 3,723,850 A * 3/1973 Daniels et al. ..... 363/126
4,038,593 A * 7/1977 Quinn ..... 363/97
4,896,192 A * 1/1990 Kinoshita ..... 399/66
5,073,848 A * 12/1991 Steigerwald et al. ..... 363/65
5,132,869 A * 7/1992 Nakaya ..... 361/233
5,341,285 A * 8/1994 Wakefield et al. ..... 363/97
5,684,391 A * 11/1997 Weinfurtner et al. ..... 323/282
6,526,240 B1 2/2003 Thomas et al.
6,930,893 B2 * 8/2005 Vinciarelli ..... 363/17
6,984,965 B2 * 1/2006 Vinciarelli ..... 323/266

FOREIGN PATENT DOCUMENTS

JP 01147557 A * 6/1989
JP 05275940 A * 10/1993
JP 2000102261 A * 4/2000

* cited by examiner

*Primary Examiner*—Robert Beatty
(74) *Attorney, Agent, or Firm*—Pillsbury Winthrop Shaw Pittman, LLP

(57) ABSTRACT

An electrophotographic document production device having a transformerless high voltage power supply located distal to its load and a transformer at the point of load.

20 Claims, 4 Drawing Sheets

POINT-OF-LOAD DESIGN FOR HIGH VOLTAGE AC POWER SUPPLIES

BACKGROUND

All references cited in this specification, and their references, are incorporated by reference herein where appropriate for teachings of additional or alternative details, features, and/or technical background.

Disclosed in the embodiments herein is an electrophotographic document production device wherein the high voltage transformer is removed from the high voltage AC power supply and placed near the load.

Certain devices have components that require a voltage high enough to cause corona discharge, a controlled static discharge. This corona discharge is used to charge or discharge a target member such as a photoreceptor belt in a xerographic copier or printer. This provides the component with sufficient instantaneous current density for proper operation, without exceeding a maximum average current value. In such components, if the required current density is greater than the desired average current, a chopped current at an appropriate duty cycle is required.

Some power supplies employ pulse amplitude modulation (PAM) for this type of use, which produces a high voltage pulse at a fixed duty cycle and varies the voltage to obtain the correct average current value. Other power supplies employ pulse width modulation (PWM) and pulse frequency modulation (PFM) all of which are used high voltage applications. In most cases, these switch-mode power conversion schemes are used to improve efficiency and reduce the size of magnetic devices such as transformers.

Among those devices that have such components are "image-on-image" xerographic color printers wherein multiple corotrons must be precision charged and controlled to provide desired print quality. FIG. 1 (prior art) is a simplified "image-on-image" xerographic color printer in which successive primary-color images are accumulated on a photoreceptor belt, and the accumulated superimposed images are in one step directly transferred to an output sheet as a full-color image.

Specifically, the FIG. 1 embodiment includes a belt photoreceptor 10, along which are disposed a series of stations, as is generally familiar in the art of xerography, one set for each primary color to be printed. For instance, to place a cyan color separation image on photoreceptor 10, there is used a charge corotron 12C, an imaging laser 14C, and a development unit 16C. For successive color separations, there are provided equivalent corotron, imaging laser and developer elements 12M, 14M, 16M (for magenta), 12Y, 14Y, 16Y (for yellow), and 12K, 14K, 16K (for black). The successive color separations are built up in a superimposed manner on the surface of photoreceptor 10, and then the combined full-color image is transferred at transfer station 20 to an output sheet. The output sheet is then run through a fuser 30, as is familiar in xerography.

Also shown in FIG. 1 is a set of what can be generally called "monitors," such as 50 and 52, which can feed back to a control device 54. The monitors such as 50 and 52 are devices which can make measurements to images created on the photoreceptor 10 (such as monitor 50) or to images which were transferred to an output sheet (such as monitor 52). These monitors can be in the form of optical densitometers, calorimeters, electrostatic voltmeters, etc.

Control of voltage to a component or load may be by way of one or more transformer(s), magnetic devices consisting of two or more multiturn coils wound on a common core, the coil connected to the energy source being referred to as the primary coil or winding and the coil in which current is induced by the primary coil being referred to as the secondary coil or winding. As understood by those skilled in the art, the turns ratio of the primary coil to secondary coil determines the transformer's voltage ratio, an increase in turns of the secondary coil with respect to the primary coil resulting in a boost of voltage at the secondary. Sensing resistors in conjunction with a potentiometer may be used at the primary coil or secondary side of the transformer to control voltage placed across the load.

Electrophotographic document production devices may employ long high voltage wires from a high voltage AC power supply to the load, such as the corotrons. The high voltage wires may produce radiated emissions, additional loading due to capacitive coupling, arcing, radiated noise and unintended corona discharge. To reduce this effect, the wires have in the past been placed in restricted locations such as in "snap-in" brackets with foam tubing around the wires to enforce strict spacing requirements around the wires. The use of an OZAC system, an architecture in which the high voltage wires are routed through ozone hoses, has also been employed.

It will be appreciated that these ozone hoses exist in the machine for the purpose of removing corrosive ozone gas from the load devices. Placing the HV wires inside these hoses is a secondary function of the hoses, not the primary function. i.e, the hoses are not filled with ozone gas to somehow "fix" the problems created by the HV wires. Rather, the relatively large diameter of the hoses serves to enforce spacing requirements on the wires inside them.

Alternatively, some systems mount the high voltage power source directly behind/above/next to the load device (so-called "point-of-load"), eliminating the need for high voltage wires altogether. Each of such correction systems requires considerable cost and design effort, and may be less than advantageous given space constraints in the device.

There is a need therefore for other methods for reducing high voltage wire extraneous effects on components in an electrophotographic document production device.

SUMMARY

Aspects disclosed herein include:

a system comprising a high voltage power supply for powering a load element, the high voltage power supply comprising a control circuit, a monitor circuit, fault logic circuit and driver; a transformer having primary windings and secondary windings, the transformer positioned distal to the high voltage power supply and proximal to the load element; a low voltage line connecting the driver of the high voltage power supply to the primary winding side of the transformer; and a high voltage wire connecting the transformer to the load element so as to provide power to the load element;

a system comprising a load; a high voltage transformerless power supply located distal to the load and operationally associated therewith; a transformer located distal to the power supply and proximal to the load, the transformer having primary windings and secondary windings; and a signal conditioning circuit operationally associated with the transformer, the signal conditioning circuit structured to sense either secondary or primary winding voltage and to adjust the voltage sense signal to serve as a low-voltage analog representation of the secondary winding voltage; and an electrophotographic document production device comprising a load; a high voltage transformerless power supply located distal to the load and operationally associated therewith; a transformer located distal to the power supply and proximal to the load, the transformer having primary windings and secondary windings; and a signal conditioning circuit operationally associated with the transformer, the signal conditioning circuit structured to sense either secondary or primary winding voltage and to adjust the voltage sense signal to serve as a low-voltage analog representation of the secondary winding voltage.

BRIEF DESCRIPTION OF THE DRAWINGS

Various of the above mentioned and further features and advantages will be better understood from this description of embodiments thereof, including the attached drawing figures wherein.

DETAILED DESCRIPTION

Figure 1:
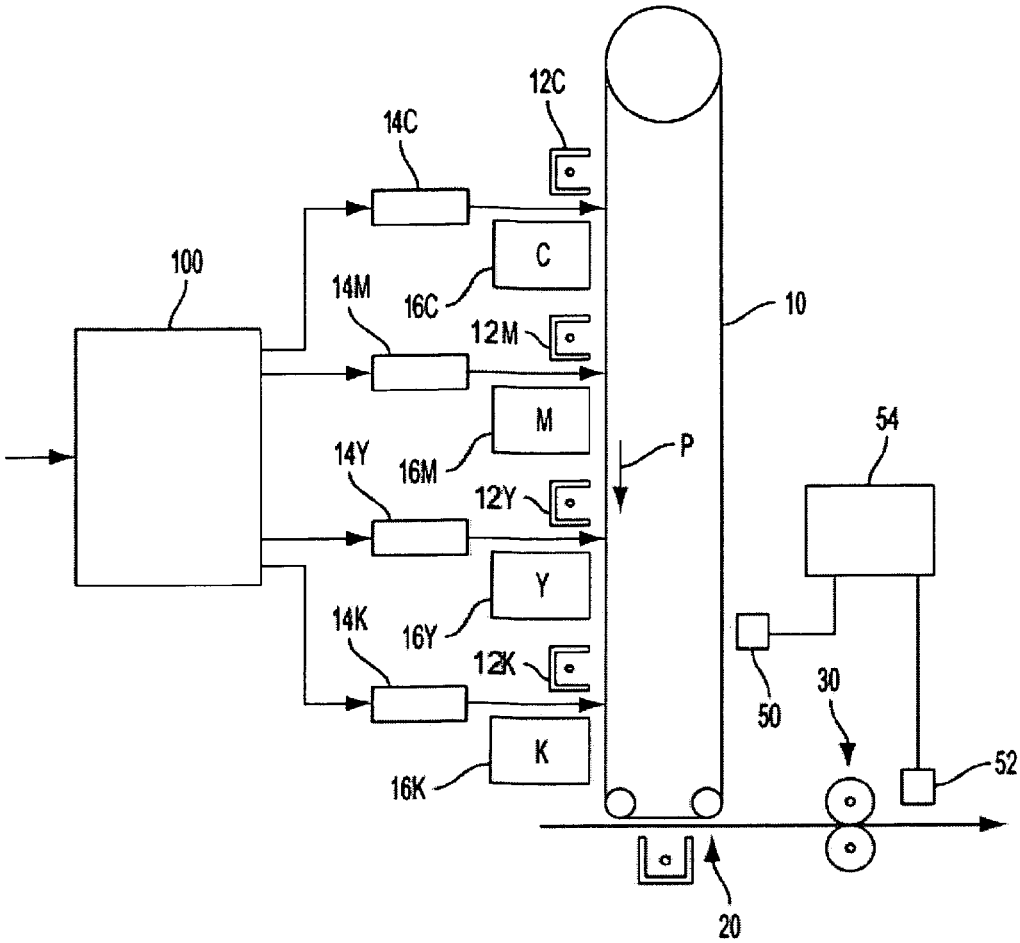
FIG. 1 PRIOR ART
FIG. 1 (prior art) shows a diagram of a simplified "image on image" xerographic color printer.

In embodiments there is illustrated a system comprising a load; a high voltage transformerless power supply located distal to the load and operationally associated therewith; a transformer located distal to the power supply and proximal to the load, the transformer having primary windings and secondary windings; and a signal conditioning circuit operationally associated with the transformer, the signal conditioning circuit structured to sense either secondary or primary winding voltage and to adjust the voltage sense signal to serve as a low-voltage analog representation of the secondary winding voltage.

In such system, the high voltage power may be an AC or an AC and DC source. The transformer may be located directly behind the load element or nearby such load element. The load may be any electrical load, including a charge generating device, such as a corotron. The signal conditioning circuit may regulate the high voltage output from the transformer, and may comprise one or more operational amplifiers, and one or more potentiometers.

As iterated above, significant problems with high voltage AC lines between the high voltage AC power source and the load devices are unwanted corona generation, radiated noise, capacitive coupling, arcing, and shielding and space considerations. Placing the high voltage power supply at the point of load may not be feasible owing to the number of loads obtaining input from the high voltage power supply and/or space considerations, for example.

In an embodiment, the transformer of a high voltage AC power source is removed and mounted by itself directly behind the load device. The bulk (the low voltage control circuitry, monitor/protection, drivers, and power amplifier) of the high voltage AC power source remains in the power supply location, and a low voltage harness is used to connect the driver to the primary winding side of the transformer. Such construct may shorten the high voltage wire to a small "pig-tail," or even a mating connector that connects the transformer directly to the load device. The design allows for remote mounting of the power supply without the need for long high voltage lines connecting the power supply to the load device. Instead, low voltage wires for the transformer's primary drive are routed between the power supply and the transformer module.

The transformer may be mounted on a small printed wire board along with a connector to allow connections from the power supply's power amplifier to the primary drive of the transformer.

As transformer primary to secondary ratio may differ, variation in output voltage may occur when transformers of varying turn ratios are substituted for one another. As the transfer and control circuitry are not co-located in such embodiments, it may not be a simple task to adjust the power supply to achieve the precise output voltage desired.

To overcome such a possible drawback, a small conditioning board may be placed along with the point-of-load transformer. The output of the circuit board may be used as the feedback source for the voltage control circuitry. The main power supply printed wire board assembly can then be separately set up and adjusted to provide exactly the primary voltage to the transformer that is required to achieve a precise voltage sense signal regardless of transformer variability. The transformer with signal conditioning circuit is thus operationally configured such that the voltage sense signal is a precise analog of the actual transformer secondary voltage. Thus, transformers of different turn ratios may be swapped independently of one another of their kind without variation in output voltage occurring. This enables the pseudo point-of-load high voltage power system to provide precisely controlled output voltage from afar.

In an embodiment, there is also disclosed a system comprising a load; a voltage transformerless power supply located distal to the load and therewith; a transformer located distal to the power supply and proximal to the load, the transformer having primary windings and secondary windings; and a signal conditioning circuit operationally associated with the transformer, the signal conditioning circuit structured to sense secondary or primary winding voltage and to adjust the voltage sense signal to a low-voltage analog representation of the transformer secondary winding voltage. The signal conditioning circuit in such embodiment may regulate high voltage output from the transformer based on the adjusted voltage sense signal.

Figure 2:
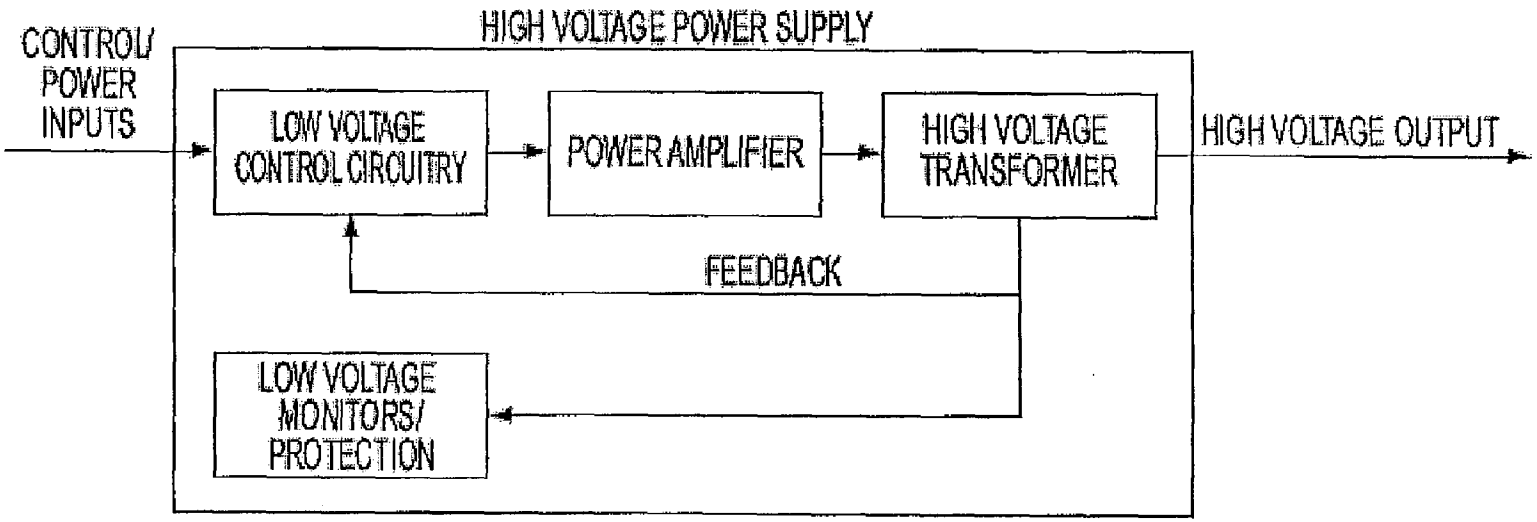
FIG. 2 PRIOR ART
FIG. 2 (prior art) shows in diagrammatic form a conventional high voltage power supply.
Figure 3:
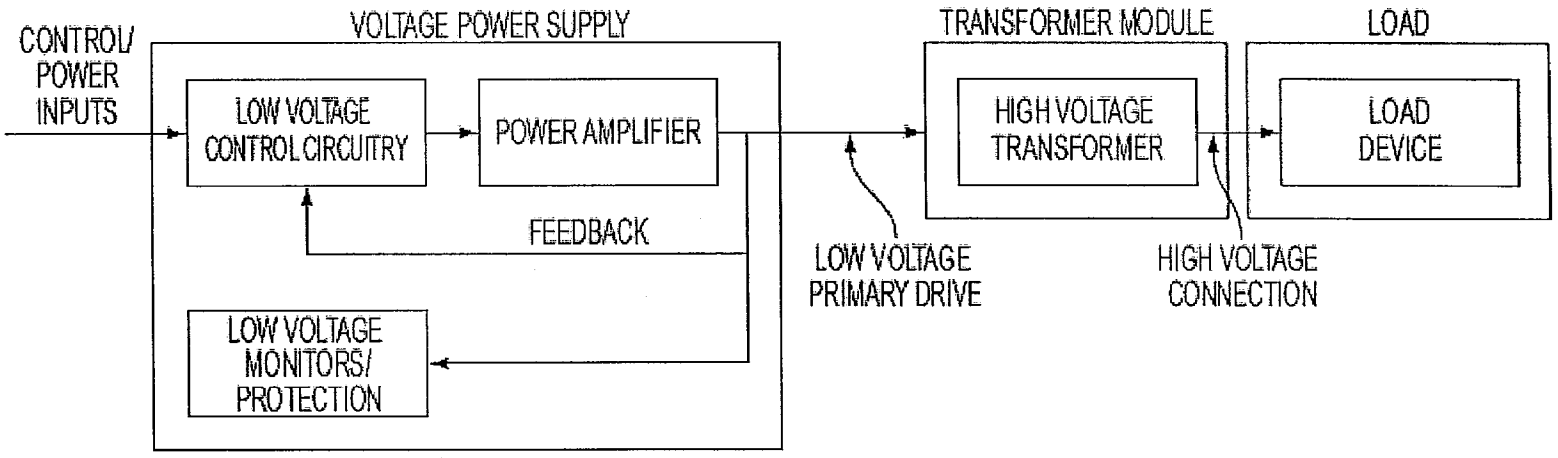
FIG. 3 shows in diagrammatic form a voltage power supply of FIG. 2 wherein the high voltage transformer is moved proximal to the point of load.

Now turning to the figures, FIG. 2 shows a diagram of a conventional high voltage power supply with the high voltage transformer contained therein. FIG. 3 shows the diagram of a transformerless voltage power supply embodiment of the present disclosure wherein the high voltage transformer is moved proximal to the load device. As depicted, running between the power amplifier and the high voltage transformer is a low voltage primary drive line. Between the transformer and the load is a short high voltage connection.

Figure 4:
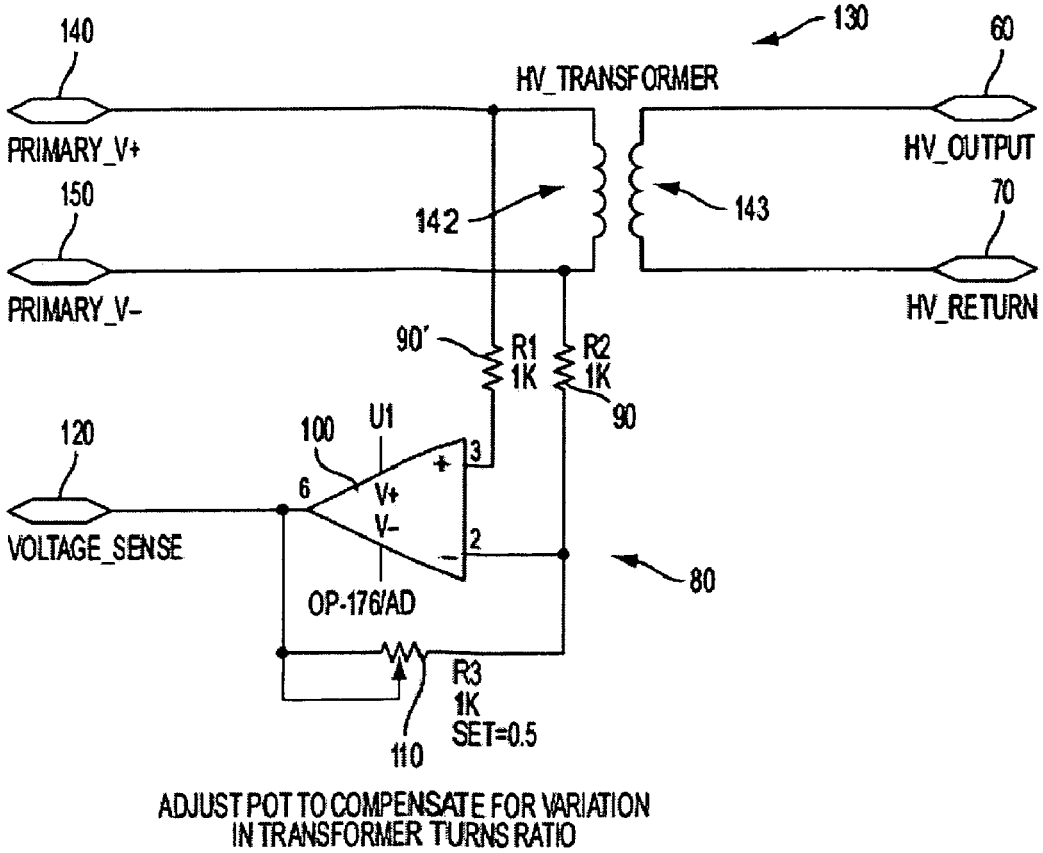
FIG. 4 is a circuit diagram of a remote voltage sensing circuit.

Now turning to FIG. 4, there is shown transformer 130 having primary V+ 140, primary V− 150, primary winding 142, secondary winding 143, high voltage output 60, and high voltage return 70. Transformer 130 is connected to exemplary voltage sensing circuit 80 through resistors 90, 90'. Voltage sensing circuit 80 comprises potentiometer 110 and operational amplifier 100 for altering voltage sense 120. As would be understood by the skilled artisan, other circuit designs can be configured to provide similar operational effects.

While the invention has been particularly shown and described with reference to particular embodiments, it will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system comprising:

a high voltage power supply for powering a load element a transformer having primary windings and secondary windings, said transformer positioned distal to said high voltage power supply and proximal to said load element;

a low voltage line connecting said driver of said high voltage power supply to said primary winding side of said transformer;

a high voltage wire connecting said transformer to said load element so as to provide power to said load element; and a signal condition circuit associated with said transformer, said signal conditioning circuit structured to sense primary winding voltage and to adjust the voltage sense signal to match actual transformer secondary voltage.

2. A system in accordance with claim 1, wherein said high voltage power supply comprises a control circuit, a monitor circuit, fault logic circuit and driver.

3. A system in accordance with claim 1 wherein the high voltage power supply is AC.

4. A system in accordance with claim 1 wherein the high voltage power supply is AC and DC.

5. A system in accordance with claim 1 wherein the load comprises one or more charge generating devices.

6. A system in accordance with claim 5 wherein the charge generating devices are corotrons.

7. A system in accordance with claim 1 wherein the transformer is located directly behind the load element.

8. A system in accordance with claim 2 wherein the signal conditioning circuit regulates high voltage output from said transformer.

9. A system in accordance with claim 2 wherein said signal conditioning circuit comprises one or more operational amplifiers.

10. A system in accordance with claim 2 wherein said signal conditioning circuit comprises one or more potentiometers.

11. A system comprising a load;

a high voltage transformerless power supply located distal to said load and operationally associated therewith;

a transformer located distal to said power supply and proximal to the load, said transformer having primary windings and secondary windings;

a signal conditioning circuit operationally associated with said transformer, said signal conditioning circuit structured to sense primary winding voltage and to adjust the voltage sense signal to match the transformer secondary winding voltage.

12. A system in accordance with claim 11 wherein the high voltage transformerless power supply is AC.

13. A system in accordance with claim 11 wherein the high voltage transformerless power supply is AC and DC.

14. A system in accordance with claim 11 wherein said signal conditioning circuit regulates high voltage output from said transformer based on the adjusted voltage sense signal.

15. A system in accordance with claim 11 wherein the load comprises one or more charge generating devices.

16. A system in accordance with claim 15 wherein said charge generating device is a corotron.

17. A system in accordance with claim 11 wherein said signal conditioning circuit comprises one or more operational amplifiers.

18. A system in accordance with claim 11 wherein said signal conditioning circuit comprises one or more potentiometers.

19. An electrophotographic document production device comprising a load;

a high voltage transformerless power supply located distal to said load and operationally associated therewith;

a transformer located distal to said power supply and proximal to the load, said transformer having primary windings and secondary windings;

a signal conditioning circuit operationally associated with said transformer, said signal conditioning circuit structured to sense primary or secondary winding voltage and to adjust the voltage sense signal to a low-voltage analog of the transformer secondary winding voltage.

20. The electrophotographic document production device of claim 19 comprising a xerographic document production device.

* * * * *